United States Patent [19]

Holm

[11] 4,135,826

[45] Jan. 23, 1979

[54] VIBRATORS

[76] Inventor: Harold K. Holm, 410 W. Harvey, Santa Ana, Calif. 92707

[21] Appl. No.: 786,336

[22] Filed: Apr. 11, 1977

[51] Int. Cl.[2] ..... B01F 11/00

[52] U.S. Cl. ..... 366/116; 74/61; 366/128

[58] Field of Search ..... 366/116, 117, 120, 123, 366/127, 128; 128/36, 46, 49, 32, 34; 310/81; 74/61

[56] References Cited

U.S. PATENT DOCUMENTS

| | | | |
|---|---|---|---|
| 2,430,817 | 11/1947 | Jackson | 366/123 |
| 2,478,701 | 8/1949 | Maginniss | 310/81 |
| 2,775,434 | 12/1956 | Probst | 366/120 |
| 3,128,082 | 4/1964 | Cline | 366/128 |
| 3,410,528 | 11/1968 | Clark | 366/123 |
| 3,964,646 | 6/1976 | Yazawa | 366/128 |

*Primary Examiner*—Robert W. Jenkins
*Attorney, Agent, or Firm*—Grover A. Frater

[57] ABSTRACT

A vibrator is prevented from transmitting its vibratory motion to the vibrator holder, such, for example, as a handle, by interconnecting the vibrator and handle with a spring arranged so that the spring serves as a resilient cantilever. Amplitude of vibrations are enhanced without a corresponding increase in the amount of vibration transmitted to the handle by arranging the resilience of the spring and the mass of the vibrator to be resonant at the frequency of vibrations or at a submultiple of those frequencies.

14 Claims, 5 Drawing Figures

VIBRATORS

IMPROVEMENTS IN VIBRATORS

This invention relates to improvements in vibrators, and it relates particularly to improvements in vibrators that are to be hand held.

BACKGROUND OF THE INVENTION

Vibrators have a variety of applications, and they often are produced in specific forms to make them particularly suitable for one application or another. Nonetheless, while vibrators may be very dissimilar, they do have problems in common. At least those whose function is to vibrate something other than their supporting or mounting structure, share the problem that it is difficult to isolate the base or mounting structure from the vibrations that are produced by the unit. Inability to isolate vibrations has been particularly troublesome in the case of hand held vibrators whose function is to apply vibrating force or motion to something other than the user's hand. The problem appears to have gone largely unsolved.

SUMMARY OF THE INVENTION

It is an object of this invention to provide improved vibrators and, particularly, to provide improved hand held vibrators. It is an object of the invention to provide a means by which the handle of a vibrator whose vibrating portion is to be carried by a handle will be largely isolated from vibratory action. A further object is to provide a hand held vibrator in which a cyclically moving or vibrating motion and force imparting element is mounted on a handle in a way that tends to isolate the handle from the motion of the vibrating element whether the cyclical or vibratory motion occurs along a single line or can occur in any direction in a plane extending through the vibrating element. In that connection, it is an object of the invention to provide a hand held vibrator in which the handle is isolated from vibrations that occur in the form of circular motion of the vibrating member. These and other objects and advantages of the invention, which will hereinafter appear, are realized in part by the use of a resilient means for connecting the operating or vibrating element and the handle in such a way that the resilient means, ordinarily a spring, flexes in a degree that is proportional to vibratory movement of the operating member. That is accomplished by use of a cantilever spring oriented so that it will flex in response to movement of the vibrating element.

In the case of a vibrating element that vibrates with circular motion, the preferred form of the invention employs a coiled spring to interconnect the operating element and handle. The coiled spring permits cantilever action in any direction transverse to its length. It reacts to circular motion of the vibrating element to isolate the handle from that vibratory motion in every portion of its circular motion.

By relating the resonant frequency of the vibrating operating member and the spring to the vibration frequency so that those frequencies are the same or harmonically related, a much greater amplitude of vibration of the operating element is made possible for a given amount of input energy. Conversely, a lesser energy is required to produce a given amount of vibratory motion than has been possible in the past. To provide that advantage is another object of the invention.

The required frequency relationship can be developed by altering the vibration frequency or by altering the resilience of the spring connection between vibrating element and handle.

IN THE DRAWINGS

DESCRIPTION OF THE PREFERRED EMBODIMENTS

Figure 1:
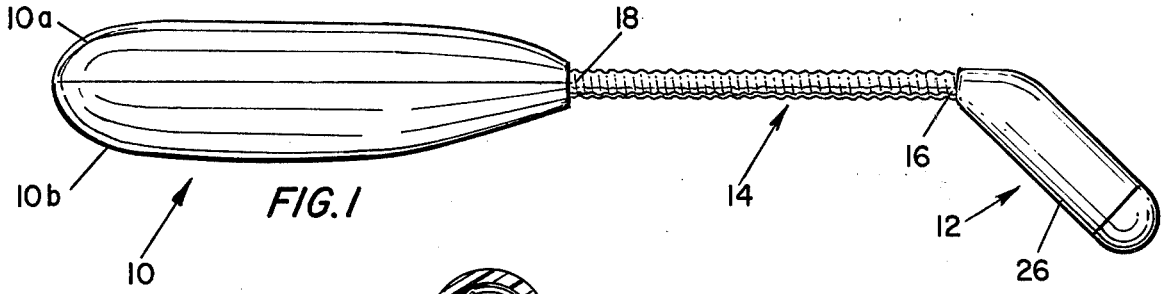
FIG. 1 is a view in side elevation of a vibrator embodying the invention.

The vibrator unit shown in FIG. 1 includes a holder 10 which, in this form of the invention, comprises a handle by which a user can hold the device comfortably in either hand. The handle 10 comprises an upper part 10*a* and a lower part 10*b*. It is connected to the vibrating or cyclically moving element 12 by a resilient interconnecting means 14 which, in the preferred embodiment, comprises a spring. The spring 14 assembly serves as a cantilever spring. It is connected at its end 16 to the vibrating unit or element 12 and it is connected at its end 18 to the handle, and it is capable of flexing. In operation of the device, the vibrating unit 12 is set into motion while the handle is held in the user's hand. Using the handle, the vitrating unit 12 is pressed against the area, or is inserted into the area, which is to be vibrated. The interconnecting means 14, while resilient, is sufficiently stiff so that an amount of pressure equal to the task can be brought to bear by the vibrating element 12 against the area to be vibrated. The user simply presses on the handle until the interconnecting spring assembly 14 has been flexed to the point where it exhibits the amount of force that is to be applied to the subject of vibratory motion.

The spring assembly 14 exhibits a resilience capable of storing energy and of forming an oscillatory system with the mass of the vibrating element. As a consequence of that, very little vibratory motion is transmitted to the holder which, in this case, is the handle 10. Isolation of the handle from vibratory motion results in the fact that the spring is free to flex as a cantilever. If the vibratory motion of element 12 was in a direction toward and away from the handle so that its forces would be transmitted longitudinally along the spring, then the spring would not act as a cantilever. If it was tightly wound so that its coils were compressed together, it would perform like a rod transmitting vibrating motion directly to the handle in one direction and acting as an extension spring in response to vibration in the other direction, in which case a similar force, occuring out of phase with the motion, would be transmitted to the handle. Accordingly, the invention is best practiced when the vibrating element, such as the element 12, is made to vibrate in a direction other than along a line connecting it with the handle. The invention may use any of several forms of vibratory motion producing elements. Thus, for example, it may employ an ordinary electromagnetic solenoid which is energized from a power source through a make-and-break circuit. Structures of that kind ordinarily result in vibratory motion that is limited to motion along a given line. If that kind of an apparatus is employed in the invention, it could be oriented so that its line of action did not extend through the handle, thus eliminating a source of vibration.

The vibrator may also comprise a motor having a continuously rotating output shaft which is made to move a mass so that an oscillatory, circular motion results. That can be done in a variety of ways, but one of the simplest is simply to connect the mass to the rotating output element or shaft of the motor so that the center of gravity of the mass does not lie on the axis of rotation of the motor. Such an element is called an "eccentric," and that is what is employed in the preferred embodiment shown in the drawings. The mass 20 is a cylindrical weight. It is provided with a bore formed through the weight parallel with, but offset from, the central axis of the weight. It is mounted upon the shaft 22 of a uni-directional motor 24. The latter is fitted into retaining conformations in the interior of a housing 26 which, in this case, is divided into a rearward portion **26*a* and a rounded forward end 26*b***. Those parts are joined in the finished assembly.

Power leads 32 extend from the motor through the housing 26 into the end of a coiled compression spring 34 which is covered with a plastic sheath 36. Together, the spring and sheath form the spring assembly 14.

The wires extend entirely through the spring and emerge at the opposite end in the interior of handle 10 in which the lower end 18 of the spring 34 is fastened. One of the wires, numbered 44, is connected to a metal bracket 46 made of spring material which extends through the interior of the handle 40 to its rearward end where it is folded over and trapped in place by a conformation 47 of the plastic case. That bracket 46 serves as a conductor from the negative terminal of a battery set comprising batteries 50 and 52. Those batteries are connected in series. The negative, bottom end, of battery 52 rests on an end of the spring metal bracket 46. Thus it is that the negative side of the battery set is connected through the spring bracket 46 and the conductor wire 44 to the motor 24. The wire is soldered or fastened by any other convenient means to bracket 46.

The positive terminal 58 of the battery set bears against an S-shaped metal clip or bracket 68 whose other end is trapped in a conformation 69 of the housing. A wire 70 is soldered or otherwise connected between bracket 68 and a terminal lug of a slide rheostat 60. Unit 60 is a simple slide rheostat. Movement of its handle 64 moves a contact over a resistance wire. At one end of its motion it is disengaged from the resistance wire so that a switch action is provided as well as the rheostat function.

Figure 2:
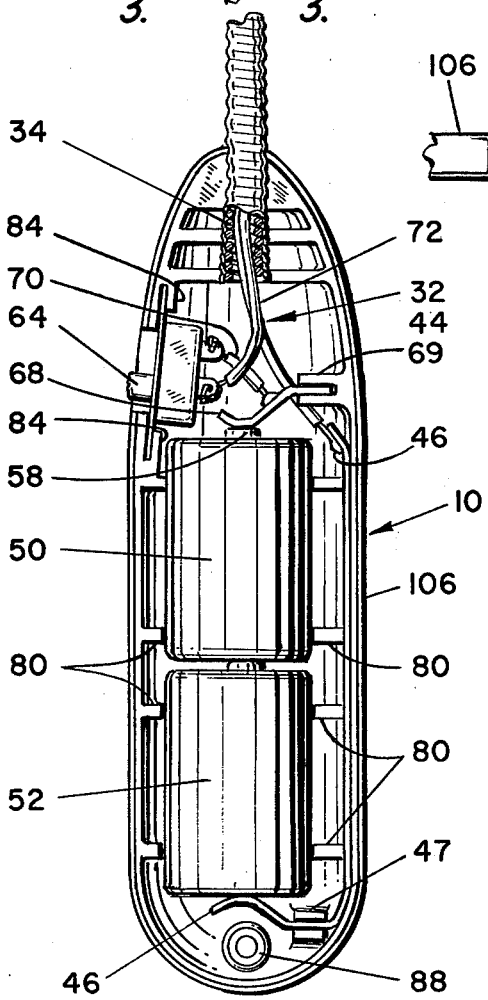
FIG. 2 is a fragmented, cross-sectional view of the vibrator of FIG. 1 taken on a plane perpendicular to the page in the case of the handle, and taken on a plane parallel to the page in the case of the vibratory unit.

In FIG. 2 the handle portion of the apparatus is shown with the upper portion removed looking down into the lower half **10*b* of the handle. The batteries are held in place by a series of ribs 80 formed integrally with the handle portion. Similar ribs, not shown, are employed in the handle section 10*a* for the same reason. Similarly, the upper and lower portions of the handle are provided with conformations which trap and hold the rheostat in place. In the lower handle section, those conformations are identified by the reference numeral 84. Other conformations, some of which are identified by numeral 86, serve to hold the spring assembly in the handle. Finally, the boss 88 is arranged to receive a self-tapping screw which is inserted through the upper handle section 10*a*** and serves to hold the handle sections together at the rear.

The other lead 72 from the motor is connected to a terminal of the combined switch and rheostat unit 60. It will be understood that other connection elements could be substituted for those shown if they will serve to complete the circuit correctly.

Figure 4:
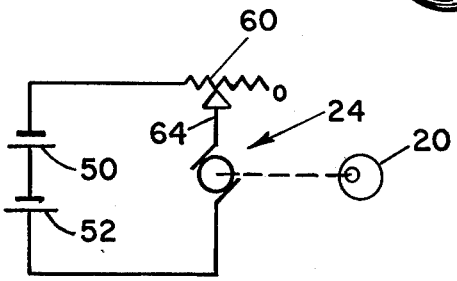
FIG. 4 is a schematic diagram of the vibrator.

The circuit is reproduced schematically in FIG. 4. The motor is of a type whose speed varies with applied voltage. It will be apparent in FIG. 4 that adjustment of the rheostate will result in a change in the applied voltage and, therefore, in the speed of rotation of motor 20 and in the eccentric mass 20.

Figure 3:
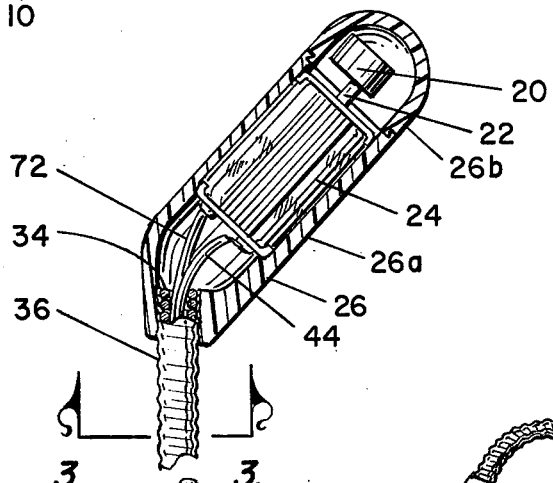
FIG. 3 is a cross-sectional view taken on line 3—3 of FIG. 2.
Figure 3:
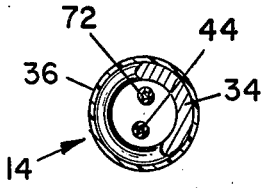

The resilient interconnecting means 14 is shown in cross-section in FIG. 3. As previously described, it comprises a coiled extension spring 34 which is covered by a protective plastic sheath 36. The coils of the spring are tightly wound and are pressed together in the relaxed condition of the spring. In that condition, the spring and its axis extend in a straight line. If bent, adjacent coils tend to separate. The sheath 36 precludes unwanted materials and things from entering into the space between adjacent coils that might be pinched or that might prevent return of the spring to straight condition. Any suitable material may be used. In this case, the sheath is formed by "heat shrink" tubing. Originally larger in diameter than the coil, that kind of tubing shrinks to form a tight sheath when heated.

Figure 5:
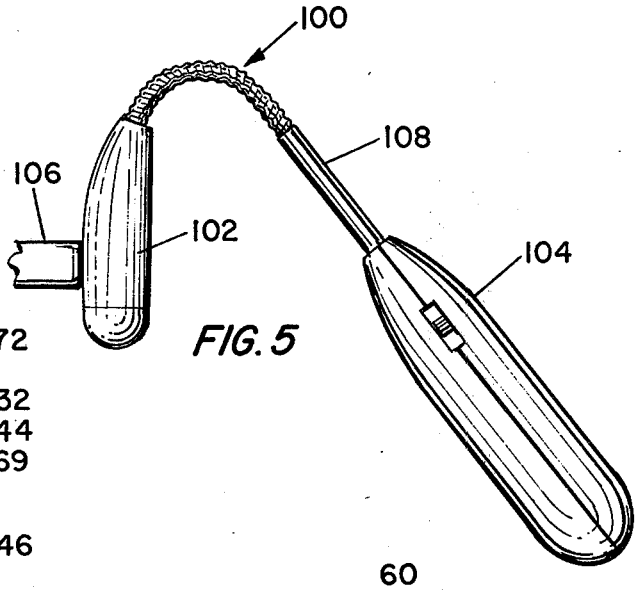
FIG. 5 is a view in side elevation of an alternative form of vibrator.

The spring rate, or degree of stiffness of the spring, is selected in view of several considerations. It is a purpose of the spring to isolate the handle from vibratory forces that would be transmitted to it from the vibrating unit 12 if the connection between unit 12 and the handle were made of some solid material. Another purpose is to permit the vibrating portion of the unit to be pressed into engagement with whatever area is to be vibrated without being required to orient the handle in a particular direction to permit engagement of the two, and the application of force. That is illustrated in FIG. 5 where the spring 100, which interconnects the vibratory portion 102 of the unit with the handle 104, is bent through an arc. It is bent when the handle 104 is oriented to utilize the force of the spring to urge the vibratory member 102 against some element, such as element 106, to which vibratory motion is to be applied.

In the embodiment illustrated in FIG. 5, part of the interconnecting means that joins the vibratory unit with the handle is made of inflexible straight tubing. That section 108 has been substituted for a portion of the length of the spring that would otherwise have been used. Inflexible tubing was used to achieve a desired degree of separation of vibrating unit and handle while limiting the resilience exhibited by the spring. That illustrates another feature of the invention. It is possible to increase the amplitude of vibratory motion of the vibrating unit by arranging its mass and the resilience exhibited by the spring such that the two have their natural resonant frequency at the vibrational frequency of the vibrating unit or a sub-multiple of that frequency. That natural resonant condition can be reached by changing the vibration frequency. That can be done by adjusting the rheostat 60 to change the voltage applied to motor 24.

Returning to FIG. 2, it will be apparent that the use of the eccentric weight 20 will result in a vibratory motion in which the outer end **26*b* of the vibrating unit 12 tends to revolve in a circular path about an axis that would be substantially coincident with the motor axis in the absence of motor rotation and vibration. In the oscillatory condition, the oscillatory motion of the end 266 appears as a revolution about a pivot point located substantially at the junction of the spring and the unit 12. As a consequence of that, the spring assembly 14** tends to bow along its length and to oscillate about its central axis in an action not unlike the motion of a child's jump-rope. The form of the motion is changed somewhat when the mechanical resonant frequency does not match the vibration or oscillation frequency. However, whether the system is resonant or not, the amount of force that is transmitted to the handle is very small compared to what it would be if the inner connection between the vibrating unit or head and the handle was made by a solid connection.

Because of the use of an eccentric mass in FIG. 2, vibratory motion is not directed along a single line, but occurs in all directions in a plane substantially perpendicular to the motor axis. In view of that, it will be apparent that the vibrating unit, or head, which in this example, is tilted at an angle of approximately 30° from the axis of the interconnecting spring, could be mounted at any angle to that spring without loss of the advantages that are provided by use of the spring as an interconnecting element.

Although I have shown and described certain specific embodiments of my invention, I am fully aware that many modifications thereof are possible. My invention, therefore, is not to be restricted except insofar as is necessitated by the prior art.

I claim:

1. In a vibrator:

(a) a mass;

(b) motive means for importing vibratory motion to the mass;

(c) a holder; and (d) interconnecting means for supporting said mass at a distance from said holder while insulating the holder in part from vibratory motion of said mass comprising a resilient arm in the form of a cantilever the cantilever comprising a coiled extension spring.

2. The invention defined in claim 1 in which said motive means comprises an electromagnetic structure having an element movable by magnetic force;

said mass being connected to and movable with said element.

3. The invention defined in claim 2 in which said motive means comprises a motor having a rotating output element and in which said mass comprises a weight mounted on said rotating element with its center of mass displaced from the axis of rotation of said rotating element.

4. The invention defined in claim 3 in which both motor and mass are mounted together at said one end of said spring.

5. The invention defined in claim 4 which further comprises a housing in which said motor and mass are housed; and means for rotating said motor at a rotational frequency corresponding substantially to an integral multiple of the resonant frequency of said spring and the combined mass of said housing and said motor.

6. The invention defined in claim 5 which further comprises means for adjusting the frequency of rotation of said mass.

7. The invention defined in claim 5 in which the cantilever spring is effective in relaxed condition to hold the holder such that its central axis is substantially parallel with the central axis of said cantilever spring and to hold said housing such that the axis of rotation of said mass extends obliquely at an angle from said axis of said spring.

8. The invention defined in claim 7 in which said housing is formed with a wall, at the side away from said holder, which extends in a direction parallel to the axis of rotation of said mass whereby vibratory action occurs in a direction perpendicular to said wall.

9. The invention defined in claim 4 in which said holder comprises a handle.

10. The invention defined in claim 9 in which said motor is battery powered and which further comprises a battery housed in said handle and conductor wires interconnecting said motor and said battery.

11. The invention defined in claim 10 which further comprises means for altering the rotational frequency of said motor by altering the voltage applied across said motor.

12. The invention defined in claim 3 which further comprises a housing in which said motor and mass are mounted and in which said interconnecting means comprises a coiled compression spring connected between said housing and said holder such that it acts as a cantilever spring.

13. The invention defined in claim 12 in which said interconnecting means further comprises a length of rigid tubing.

14. The invention defined in claim 13 in which said length of tubing is connected between said spring and said holder.

* * * * *